US008596455B2

(12) United States Patent
Babcock et al.

(10) Patent No.: US 8,596,455 B2
(45) Date of Patent: Dec. 3, 2013

(54) ADAPTER FOR WIRE DISPENSING CARTON

(75) Inventors: Kenneth R. Babcock, Bellflower, CA (US); James H. Coffey, Ponte Vedra, FL (US)

(73) Assignee: Paige Electric Company, L.P., Union, NJ (US)

( * ) Notice: Subject to any disclaimer, the term of this patent is extended or adjusted under 35 U.S.C. 154(b) by 1169 days.

(21) Appl. No.: 11/675,755

(22) Filed: Feb. 16, 2007

(65) Prior Publication Data

US 2007/0215502 A1 Sep. 20, 2007

Related U.S. Application Data

(63) Continuation-in-part of application No. 11/375,727, filed on Mar. 15, 2006.

(60) Provisional application No. 60/722,643, filed on Sep. 30, 2005.

(51) Int. Cl.
*B65D 85/00* (2006.01)

(52) U.S. Cl.
USPC ..... 206/395; 206/397; 206/408; 242/404.3; 242/588

(58) Field of Classification Search
USPC ..... 242/588, 588.5, 588.6, 404.3; 206/395, 206/397, 408, 409; 211/44, 78, 164, 85.5; 248/200, 213.2, 300, 316.8, 905
See application file for complete search history.

(56) References Cited

U.S. PATENT DOCUMENTS

| | | | | |
|---|---|---|---|---|
| 851,367 | A | | 4/1907 | Mossberg |
| 922,695 | A | * | 5/1909 | Haas ..... 206/408 |
| 2,890,821 | A | | 6/1959 | Becker |
| 3,178,092 | A | | 4/1965 | Munana et al. |
| 3,184,053 | A | * | 5/1965 | Eldridge ..... 242/588.6 |
| 3,229,812 | A | | 1/1966 | Metzger |
| 3,982,712 | A | | 9/1976 | Bassett |
| 4,006,854 | A | | 2/1977 | Gibson et al. |
| 4,019,636 | A | | 4/1977 | Wise |
| 4,160,533 | A | | 7/1979 | Kotzur et al. |
| 4,179,030 | A | | 12/1979 | Hayes et al. |
| 4,306,687 | A | | 12/1981 | Hadtke |
| 4,373,687 | A | | 2/1983 | Zicko |
| 4,406,419 | A | | 9/1983 | Kotzur |
| D286,493 | S | | 11/1986 | Floyd |
| 4,771,889 | A | * | 9/1988 | Bauer et al. ..... 206/390 |
| 4,817,796 | A | | 4/1989 | Camillo et al. |
| 4,830,305 | A | | 5/1989 | Guggi et al. |
| 4,956,908 | A | | 9/1990 | Morse et al. |
| 5,169,058 | A | * | 12/1992 | Sample ..... 229/117.23 |
| 5,246,111 | A | * | 9/1993 | Shibazaki et al. ..... 206/409 |
| 5,447,237 | A | | 9/1995 | Carter et al. |
| 5,529,186 | A | | 6/1996 | Bass |

(Continued)

*Primary Examiner* — William A Rivera
(74) *Attorney, Agent, or Firm* — Cook Alex Ltd.

(57) ABSTRACT

An adapter for inserting into a carton containing a non-reel coil of filamentary material or wire has a shaft-receiving sleeve supported by a box structure. The adapter's structure has top, front, bottom and back walls reinforced by side gussets. The underside of the top wall, the interior of the back wall, and the top of the bottom wall of the adapter define a channel. The channel is oriented such that it may receive a shaft or rod of a wire pulling rack. The adapter may be assembled from a blank of foldable material. The adapter blank may be manufactured as a detachable element of a carton blank which is also used to construct a carton to hold a non-reel coil of filamentary material.

17 Claims, 9 Drawing Sheets

(56) References Cited

U.S. PATENT DOCUMENTS

| | | | | |
|---|---|---|---|---|
| 5,642,812 | A | 7/1997 | Hale | |
| 5,704,479 | A | 1/1998 | Barnett et al. | |
| 5,979,812 | A | 11/1999 | Kotzur et al. | |
| 6,059,220 | A | 5/2000 | Lassiter | |
| 6,341,691 | B1 * | 1/2002 | Voss | 206/397 |
| 6,766,627 | B2 | 7/2004 | Kotzur et al. | |
| 6,935,040 | B2 | 8/2005 | Alrutz et al. | |
| 7,007,799 | B2 | 3/2006 | Cote | |
| 7,168,654 | B2 | 1/2007 | Silverbrook et al. | |
| 7,347,395 | B2 * | 3/2008 | Horn | 242/598.6 |

* cited by examiner

ADAPTER FOR WIRE DISPENSING CARTON

CROSS-REFERENCES TO RELATED APPLICATIONS

This is a continuation-in-part of U.S. application Ser. No. 11/375,727, filed Mar. 15, 2006, which claims the benefit of U.S. Provisional Application No. 60/722,643, filed Sep. 30, 2005, both of which are hereby incorporated by reference.

BACKGROUND OF THE INVENTION

Filamentary materials such as wires, cables and the like are typically available to electricians or technicians in two forms, on reels or within non-reel cartons. The use of reels for the storage, transportation and dispensing of wire or cable is well known in the art. Presently, when electricians wish to dispense wire via a reel, they might attach the reel to a horizontal shaft of a pulling rack. For example, see Floyd U.S. Pat. No. D286,493. An electrician would then be able to pull the wire or cable tangentially off the reel.

However, as an electrician pulls the wire, the entire reel rotates and develops momentum. As a result, when the electrician stops pulling, the reel will continue to spin and release wire. The extra wire will often tangle or kink, requiring the electrician to untangle the wire and recoil the excess back on to the reel. Another problem with reel packages is disposal of the empty reel after all the wire has been removed.

Non-reel cartons eliminate the need for a reel and the attendant problem of recoiling. These cartons are sometimes also referred to as speed out cartons. Non-reel cartons utilize either conventional cardboard cartons or specialized cartons with dispensing guides. A single strand, or a multiconductor cable, of material is coiled with an open center ("air core") and then placed into the carton. The strand is then dispensed through an opening in a wall of the carton. The coil is unwound from the center or innermost strand without rotating the entire coil. See Wise U.S. Pat. No. 4,019,636 (which is incorporated by reference). While non-reel cartons eliminate the unraveling and recoiling problems associated with reels, these cartons have their own problems. For example, when a coil is unwound from the center of a carton placed on the floor, there can develop enough resistance to uncoiling that the entire carton may tend to slide in the direction of dispensing. This is especially true when the wire is required to make sharp bends as it feeds through a payout tube in the side of the carton. Any tangling of the wire within the carton exacerbates this problem.

Another problem with non-reel cartons has more to do with common industry practice than with the carton itself. Many electricians prefer to use a portable wire pulling rack on which they can mount several different sizes, types and colors of wire. This provides ready access to whatever type of wire is needed for a particular job. The pulling racks typically have one or more shafts on which are mounted reel type wire packages. Non-reel cartons have no structure that enables them to be mounted on such a rack. If a hole is punched by the electrician in the non-reel carton to admit the shaft, there is a risk that doing so will damage the contents of the carton. Further, even if a shaft hole is successfully formed in the carton, the carton is not strong enough to support the weight of a full coil of wire on a shaft. Pulling forces would further degrade such a jury-rigged carton.

Another problem with existing non-reel cartons is the tendency of the cartons to tear at hand-hole openings. Such openings are provided to make it easy to grasp the carton and carry it. Often users will attempt to use one hand only to lift and carry the carton by the hand-hole opening. Depending on the contents of the carton, this can cause the carton to fail in the area surrounding the opening. The hand-hole then becomes useless and the carton must thereafter be lifted from the bottom, usually using two hands. Hand-hole failure can be a particular problem if the carton has been allowed to become damp or wet. Accordingly, this invention seeks to overcome these short comings by providing an adapter for non-reel cartons that allows such cartons to be used on a wire pulling rack.

SUMMARY OF THE INVENTION

The adapter of the present invention is constructed such that it allows a non-reel carton or container to be hung from a bar, rod or shaft of a wire pulling rack with only minor modifications to the carton. The adapter has a box structure formed by walls or plates that are engageable or in contact with at least a single surface of the carton. The box structure has walls in two, three or more planes and is adapted for placement against the interior top surface of the carton or in a corner of the carton. The box structure mounts a shaft-receiving sleeve or channel. The sleeve or channel defines a passage through which a shaft may be placed. The adapter transfers gravity and pulling loads to the box structure which in turn spreads these loads over a large enough surface of the carton that the carton will not be damaged by mounting it on a wire pulling rack.

The adapter may take the form of a variety of shapes or structures. It may be manufactured from different materials, including, for example, cardboard, metal, plastic or fiberglass. The adapter may also contain one or more apertures or openings, for example, to decrease the amount of material used in construction of the adapter, to increase the strength of the adapter, or to provide handholds for the combination of the adapter and carton. The configuration of the adapter and its walls allows the adapter to be placed into a carton containing a non-reel coil of filamentary material.

The adapter may also be manufactured as a blank from materials such as cardboard, paperboard, or other foldable sheet material. The blank is then folded into a structure that may be used to convert a non-reel carton into a carton which may be hung on a rod. The adapter blank may be manufactured in combination with a non-reel carton blank. The adapter blank is removably attached to the carton blank at a perforated edge. During construction of the adapter and carton, the adapter blank is separated from the carton blank. The carton is then assembled. The carton may have two or more opposing holes or openings. The openings align with the channel or passageway of the adapter. The holes permit a shaft, rod or other instrument to be positioned through the adapter and carton, such that the carton may be hung from the instrument.

DETAILED DESCRIPTION OF THE INVENTION

Figure 2:
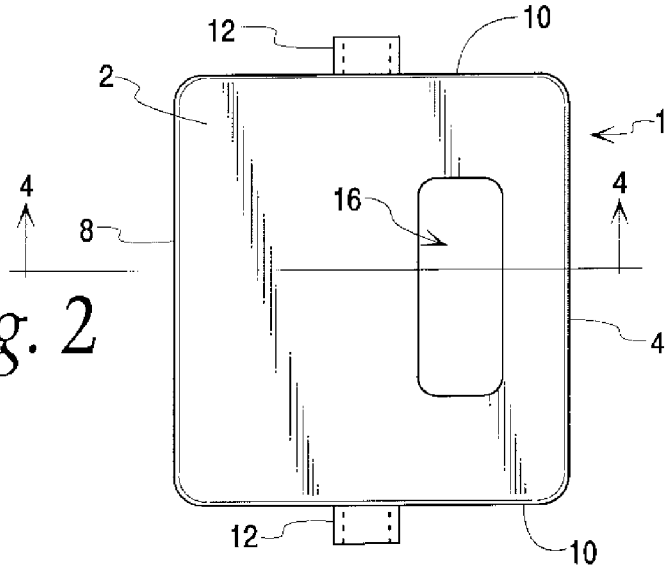
FIG. 2 is a top plan view of the adapter of FIG. 1.
Figure 1:
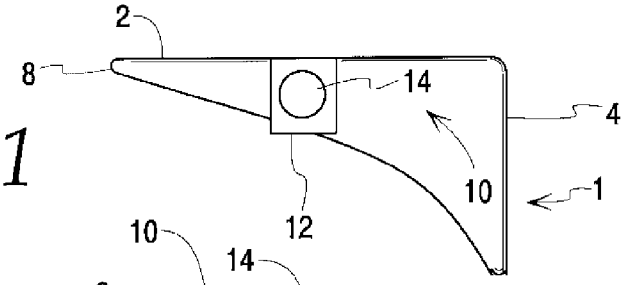
FIG. 1 is a side elevation view of one embodiment of the adapter.
Figure 3:
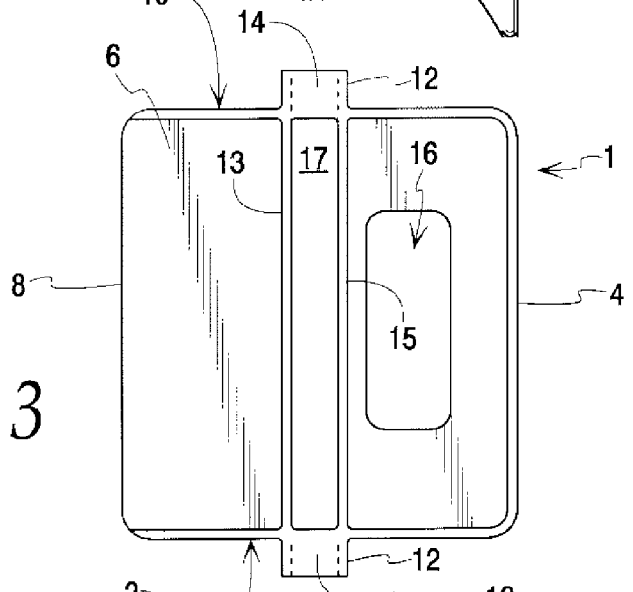
FIG. 3 is a bottom plan view of the adapter.
Figure 4:
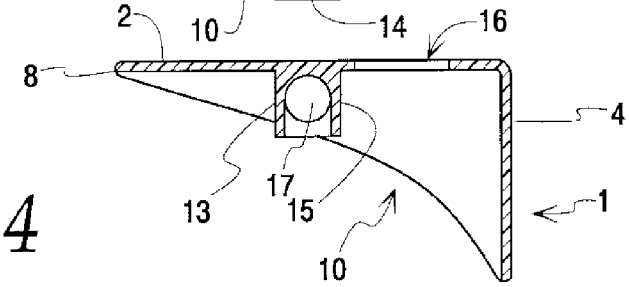
FIG. 4 is a section taken along line 4-4 of FIG. 2.

FIGS. 1-4 illustrate the adapter of the present invention generally at 1. The adapter has a box structure formed by a top plate 2, a back wall 4, and two opposing side walls 10. The top plate 2 has a free edge 8. Opposite the free edge is a right angle corner where the top plate 2 connects to the back wall 4. The side walls 10 are generally triangular gussets that join both the top plate 2 and the back wall 4. As seen in FIGS. 1 and 4 the hypotenuse of the gussets may have a curved or arched configuration, the curvature of which becomes more pronounced toward the back wall. The top plate and the back and side walls form an open-sided, box structure with surfaces in three mutually perpendicular planes.

Four-sided knobs 12 extend outwardly from the side walls 10. The top edges of the knobs are flush with the upper surface of the top wall. Openings 14 extend fully through the knobs. As explained below, when the adapter 1 is inserted into a carton, the knobs 12 provide a guide and support for a rod or shaft to be inserted into the openings 14 and through the adapter 1. In this embodiment, the knobs 12 are generally square. However, the knobs 12 could have other shapes or they could be placed in different locations with respect to the top plate and back walls.

An aperture through the top plate 2 defines a handhold 16. The handhold 16 is designed to be comfortable to grip and to carry the combination of the adapter 1 and a carton.

The underside 6 of top plate 2 has two depending walls or ribs 13 and 15. Ribs 13 and 15, together with the portion of the top plate 2 between them and the knobs 12, define a shaft-receiving sleeve. A passageway or channel 17 is defined by the ribs 13, 15 and the portion of the top plate 2 between the ribs. Channel 17 aligns with openings 14 in the knobs 12. The passageway 17 extends from one side wall 10 to the other side wall 10. The openings 14 and the channel or passageway 17 allow a bar, dowel, shaft, or rod (not shown) to be passed through the adapter 1 such that the adapter 1 may be hung from a pulling rack on the bar, dowel, shaft, or rod. The openings 14 and the passageway 17 may have different configurations to receive different shapes or sizes of rods or shafts. That is, while the openings 14 are shown with a circular cross section, the cross section could be non-circular to provide an anti-rotation feature. Also, while the channel 17 is shown open to the bottom, the fourth side of the channel may also be enclosed to fully shield a rod or shaft inserted therein.

Figure 5:
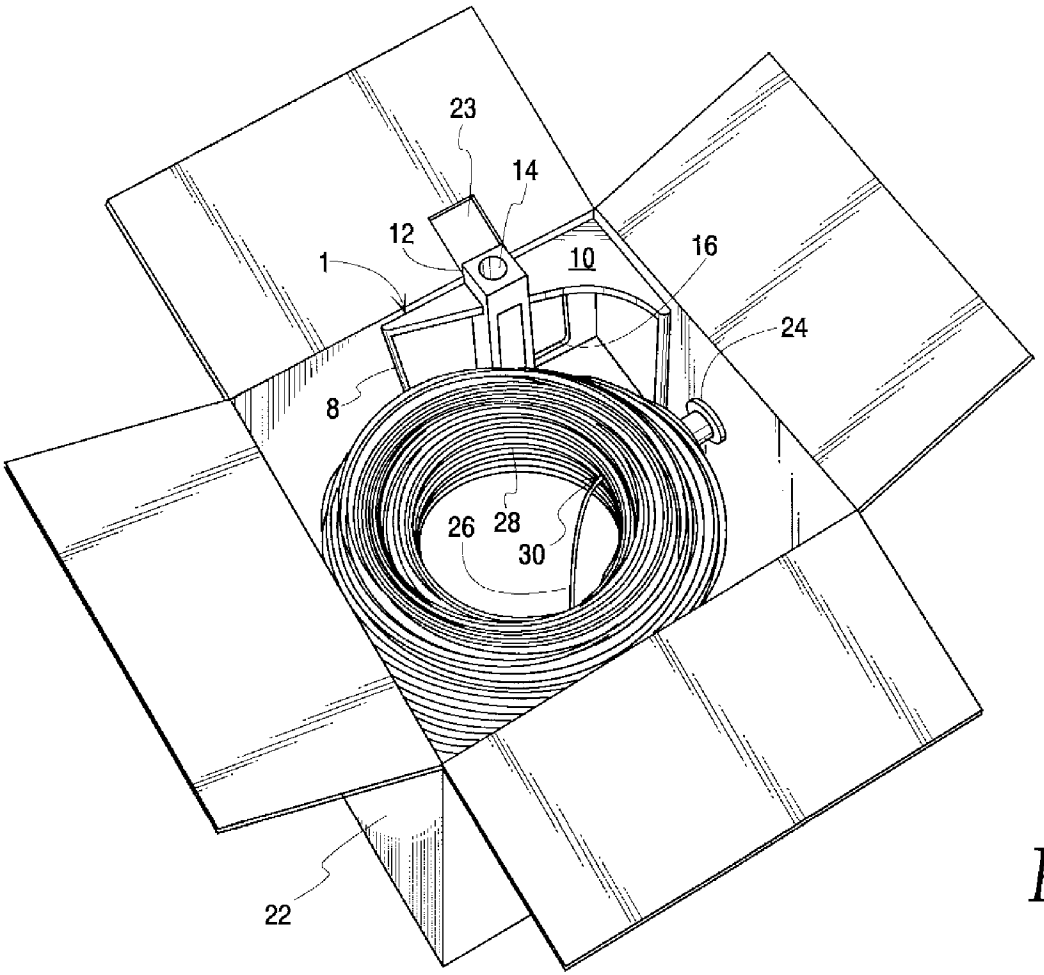
FIG. 5 is a perspective view of a non-reel wire carton with its flaps open on one side to illustrate the adapter of the present invention installed therein.

FIG. 5 illustrates the adapter in preparation for use. The adapter 1 is inserted into a corner of a carton 22 containing a non-reel or "air core" coil of filamentary material 28 such as wire or cable. Typically, these cartons 22 or containers are constructed using cardboard or similar materials. As a result, the configuration of the adapter 1 is designed to reinforce or provide structural support for the carton, such that when the carton is hung utilizing the adapter 1, gravity and pulling loads on the carton 22 are spread out over a large surface area. By spreading out these loads, the adapter 1 reduces the possibility of the carton tearing or otherwise failing. The knobs 12 extend outwardly, through cutouts 23 in the carton 22, and slightly beyond the exterior surfaces of the carton 22. The engagement of the protruding knobs 12 with the cutouts 23 locks the adaptor in place in the carton. The knobs also serve as spacers between adjacent cartons or reels on a pulling rack. It sometimes happens that a non-reel carton is placed on a rack next to a spool or reel. Rotation of the reel can potentially damage the cardboard carton of the non-reel container. The knobs absorb such contact and prevent the cardboard carton from being damaged by adjacent reels.

As shown in FIG. 5, an inner strand 26 of the non-reel coil 28 is paid out from the innermost coil 30 through the body of the coil and out the side of the carton 22 by way of a payout tube 24. The payout tube 24 is mounted in a side wall of the carton. The design and placement of the adapter 1 does not interfere with the paying out of the coil 28.

Figure 6:
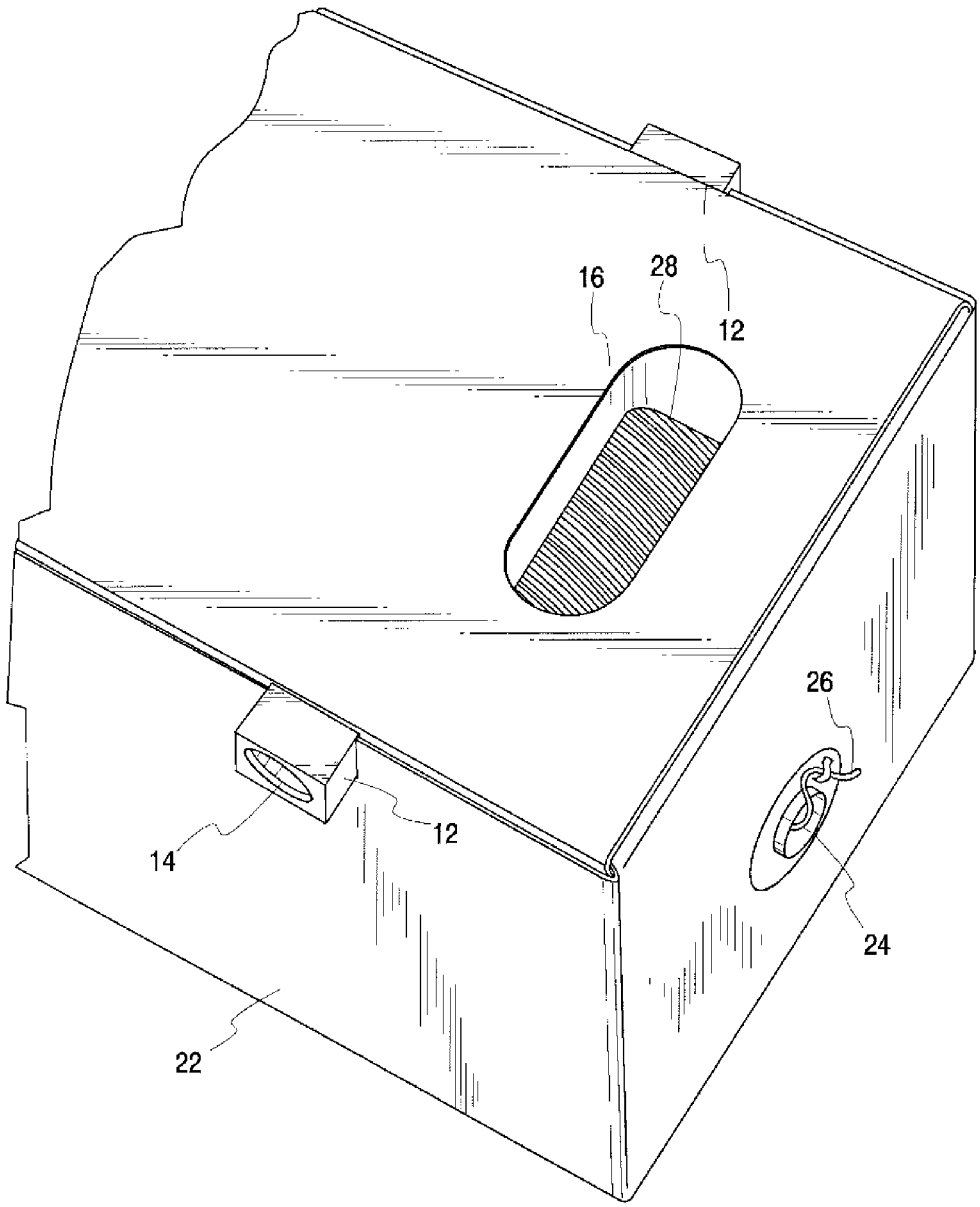
FIG. 6 is a perspective view of a non-reel wire carton that is ready to be hung from a shaft, illustrating how the adapter is situated in a closed carton containing a non-reel coil of filamentary material.

FIG. 6 shows the top of a closed carton 22 in what might be considered a normal, upright position. In this position, the adapter 1 sits in an upper corner above the payout tube 24. The knobs 12 of the adapter 1 extend outside of the closed carton 22. To hang the carton 22 from a pulling rack, a shaft of the pulling rack would be inserted into the opening 14 in one of the knobs 12, through the channel 17 and out the opposite opening 14. The ends of the shaft are then secured in the rack. As can be seen through the handhold 16, the non-reel coil 28 sits in the carton 22 in a vertical position. The strand 26 of filamentary material from the coil 28 is paid out through payout tube 24 in the side of the carton. Note also that the handhold 16 aligns with an opening in the carton 22. This allows the carton to be conveniently grasped at the handhold and carried without risk of tearing or damaging the carton, even if the carton is wet.

The adapter is preferably installed in a corner of the carton, although it could be otherwise. Placement of the adapter in a corner allows the carton to hang on a shaft at an angle so that gravity and pulling loads are spread on to two perpendicular walls. The adapter has a simple, one-piece construction that is quick and easy to install. By converting a non-reel carton for use with a pulling rack, a wire supplier can reduce the amount of inventory formerly needed for different types of packages. The adapter allows a non-reel carton to provide the benefits of a reel while avoiding its disadvantages.

The adapter may have an alternate box structure that allows the adapter to fit inside a carton or container. As shown in FIGS. 7-10, instead of having walls in three or more planes, it could be that the adapter walls only define two planes.

FIGS. 7-10 illustrate an alternative embodiment of the adapter of the present invention generally at 31. The adapter 31 has a box structure, with walls or surfaces in two perpendicular planes. The box structure is formed by a top plate 32, a stiffening wall 34, a front rib 36 and an interior rib 38. The front rib 36, the interior rib 38 and a portion of the top plate 32 define a passageway or channel 40.

An opening 42 through the top plate 32 defines a handhold. The handhold 42 is designed to be comfortable to grip and to carry the combination of the adapter 31 and a carton. Typically, non-reel cartons containing filamentary material have an opening for a handhold at the top of the carton. The handhold 42 aligns with this opening in the top of the carton. An electrician or other user of these cartons accesses this handhold by pushing into the carton one or more partially perforated flaps. The perforated flaps of the carton will pass through the handhold opening 42 of the top plate 32 and further aid in securing the adapter to the interior of a carton. This also allows the carton to be conveniently grasped at the handhold and carried without risk of tearing or damaging the carton, even if the carton is wet.

Several other smaller openings 44, may be added to the top plate to reduce the amount of material required to manufacture the adapter 31. Similarly, optional grooves 46 along the trailing edge 48, leading edge 49, and the top plate 32 may be added to further reduce the material require to manufacture the adapter 31. The grooves 46 may also further aid in securing the adapter within the carton.

The underside 50 of the top plate 32 has three depending structures, a front rib 36 and interior rib 38 and a stiffening wall 34. Ribs 36 and 38 together with a portion of the underside 50 of the top plate 32 define a shaft-receiving channel or passageway 40. The passageway 40 extends outwardly past the sides of the top plate 32. The channel or passageway 40 allows a bar, dowel, shaft, or rod (not shown) to be passed through the adapter 31 such that the adapter 31 may be hung from a pulling rack on the bar, dowel, shaft, or rod. While the channel 40 is shown open to the bottom, the fourth side of the channel may also be enclosed to fully or partially shield a rod or shaft inserted therein.

Along the trailing edge 48 is a right angle corner where the top plate 32 connects with the stiffening wall 34. The stiffening wall 34 may have numerous configurations and may contain openings 52 of various sizes and shapes. The openings may be added to reduce the amount of material needed to manufacture the adapter 31.

Figures 7, 8, 9, 10:
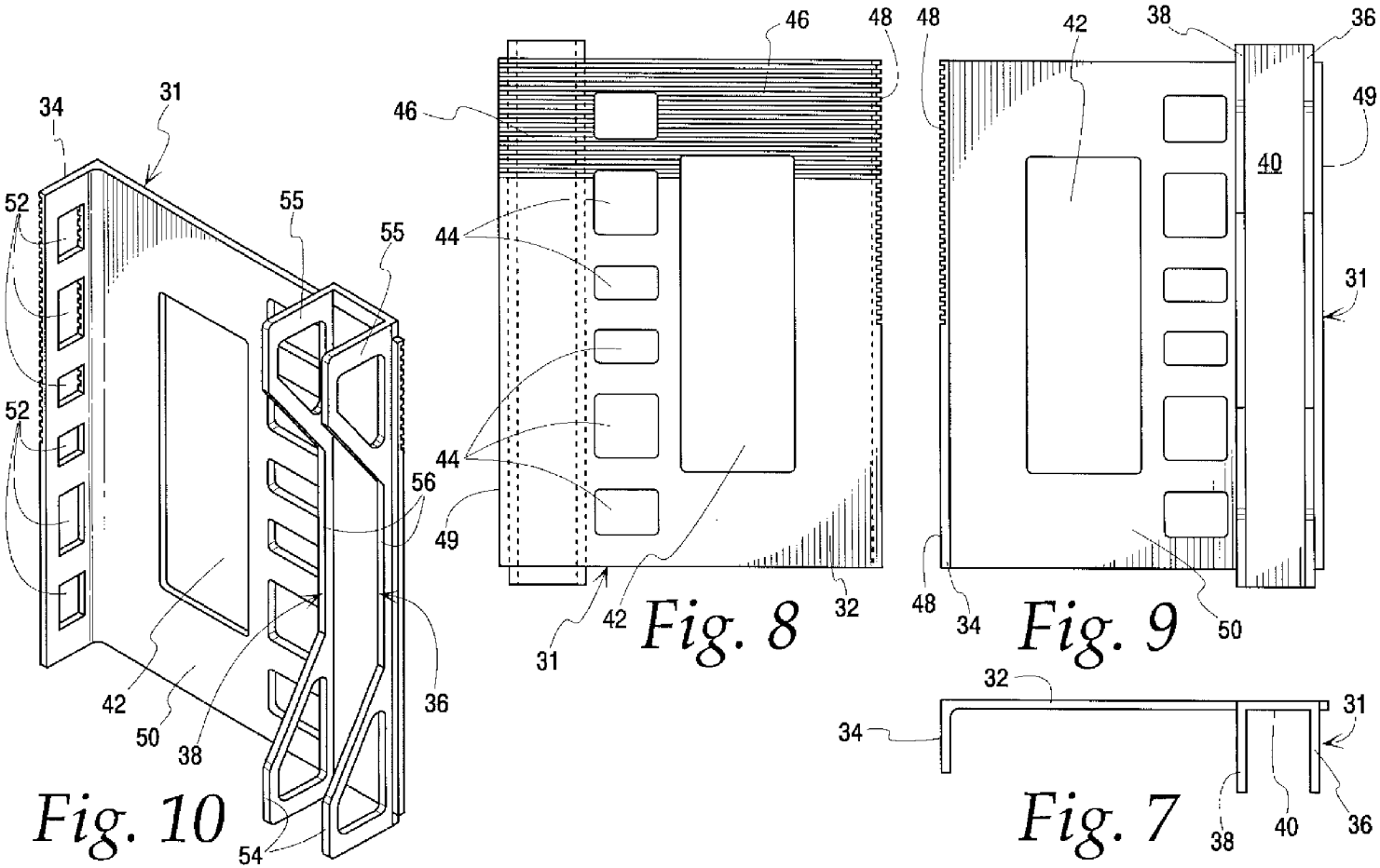
FIG. 7 is a side elevation view of an alternate embodiment of the adapter.
FIG. 8 is a top plan view of the adapter of FIG. 7.
FIG. 9 is a bottom plan view of the alternate embodiment of the adapter.
FIG. 10 is a perspective view of the adapter of FIG. 7.

Similarly, the front rib 36 and interior rib 38 may have numerous configurations and shapes. As shown in FIG. 10, the front rib 36 and interior rib 38 may be formed by two opposing trapezoidal extensions 54, 55 located adjacent to either side of the top plate 32. A ridge 56 connects the trapezoidal extensions 54, 55. The trapezoidal extensions may have openings or apertures, for example, to decrease the amount of material used in construction of the adapter or to provide handholds for both the adapter and the carton. It is not necessary for the front rib 36 and interior rib 38 to have the same configuration.

The adapter 31 is installed within a carton against the interior top surface of the carton. Placement of the adapter 31 along the top of the carton allows the carton to hang on a shaft at an angle so that gravity and pulling loads are spread along the top surface or wall of the carton. The adapter has a simple, one-piece construction that is quick and easy to install. By converting a non-reel carton for use with a pulling rack, a wire supplier can reduce the amount of inventory formerly needed for different types of packages. The adapter allows a non-reel carton to provide the benefits of a reel while avoiding its disadvantages.

The first embodiment of the adapter 1 and second embodiment of the adapter 31 may have other configurations and structures. For example, the back wall of first embodiment of the adapter 1 may be deleted. In this case, it may be desirable to have the ends of the side walls butt up against an end wall of the carton. Alternately, the two-sided box structure could be located remote from an end wall of the carton. In any case, the box structure must be designed to fit around a non-reel coil of filamentary material (wire, cable, etc.) enclosed within a carton. In another alternate embodiment, the back wall 4 of the first embodiment of the adapter 1 could be extended from that shown so a payout opening could be formed in the wall.

The first embodiment of the adapter 1 and second embodiment of the adapter 31 may also contain additional apertures or openings, for example, to decrease the amount of material used in construction of the adapter or to provide handholds for both the adapter and the carton. Accordingly, while the top plate and side walls are shown as largely continuous surfaces of the first embodiment of the adapter 1, it could be otherwise so long as the top plate prevents concentration of loads between the shaft and the carton. It may also be manufactured from different materials.

FIGS. 11-17 illustrate another alternative embodiment of the adapter of the present invention generally at 60. In this embodiment, the adapter 60 is manufactured as a blank from materials such as cardboard, paperboard, or other foldable sheet material and then is folded into a structure having surfaces in multiple planes. The adapter has a plurality of walls such as top wall or panel 62, a front wall 64, a back wall 66, bottom wall 68, an overlapping wall 70 and side walls or gussets such as gusset 72. Flanges, such as flange 80, extend from the back wall. The adapter 60 may also include a cutout 84 for a handhold.

Figure 12:
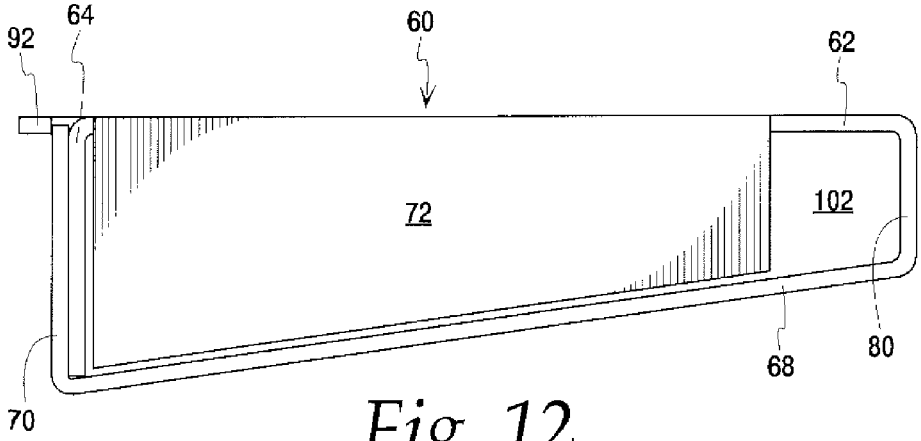
FIG. 12 is a side elevation view of the adapter of FIG. 11.

The adapter has a channel or passageway 102 for receiving a shaft or rod. As shown in FIG. 12, the interior portion of the back wall 66, the underside of the top wall 62 adjacent the back wall 66, the interior portions of the bottom wall 68 adjacent to the back wall 66, and the edges of the gussets 72 and 74 define the channel or passageway 102.

Figure 13:
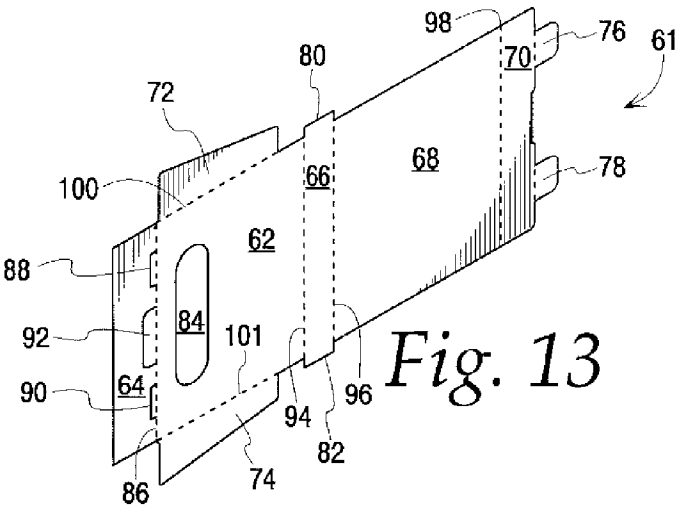
FIG. 13 is a perspective view of a blank for forming the adapter of FIG. 11.

FIG. 13 illustrates a blank 61 that is used to assemble the adapter 60. The adapter blank 61 comprises a plurality of panels that, when folded, form the walls of the adapter. Fold lines, scores or flexible hinges such as fold lines 86, 94, 96, 98, 100 and 101 created in the material generally separate the adapter blank 61 in to a top wall or panel 62, a front wall 64, a back wall 66, a bottom wall 68, an overlapping wall 70, and side walls or gussets 72 and 74. The blank 61 also includes tabs 76 and 78 that protrude from the overlapping wall 70 and flanges 80 and 82 that extend a short distance laterally from the back wall 66. The blank 61 may also include a cutout or hole 84, which aligns with the handhold of a carton when the assembled adapter is inserted in the carton.

Figure 11:
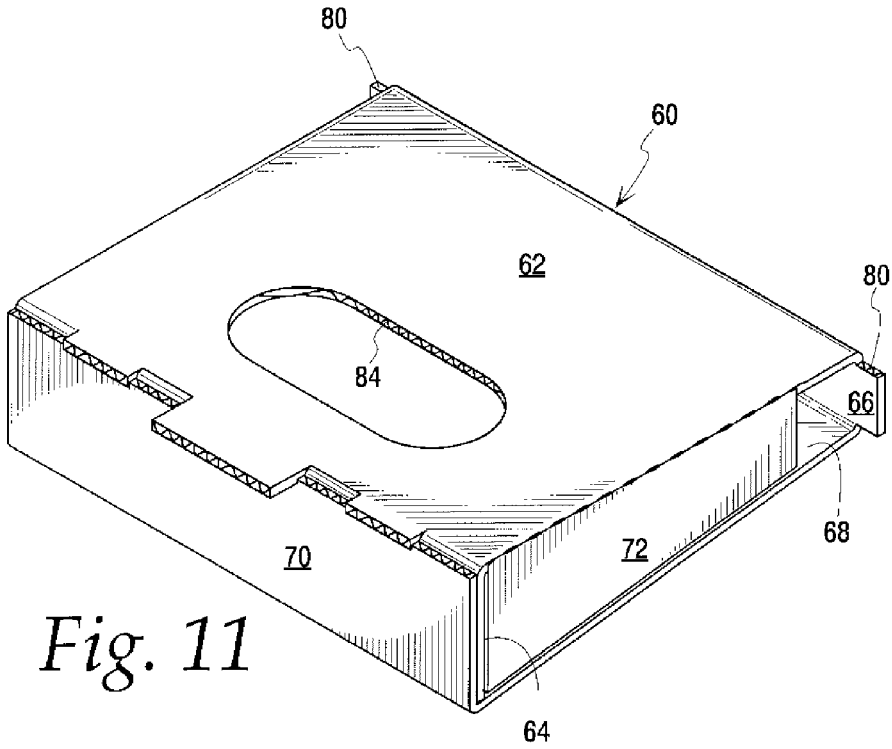
FIG. 11 is a perspective view of an alternate embodiment of the adapter.

FIGS. 14-17 demonstrate how the blank 61 is folded to construct the adapter as show in FIGS. 11 and 12. First, the front wall 64 is folded about flexible hinge or fold line 86 at substantially a 90 degree angle inwardly toward the underside of the top wall 62. When the front wall is folded into this position, tabs 88 and 90 protrude from the edge formed with top wall 62 and the front wall 64. Slots 88*a* and 90*a* are created in the front wall directly underneath tabs 88 and 90 when the front wall 64 is folded away from tabs 88 and 90. Tab 92 is also exposed when the front wall 64 is folded along fold line 86. Tab 92 is generally longer than tabs 88 and 92 may be inserted in a respective slot hosted by a carton. The combination of tab 92 and its respective slot helps to secure the adapter in the corner of the carton.

Figure 15:
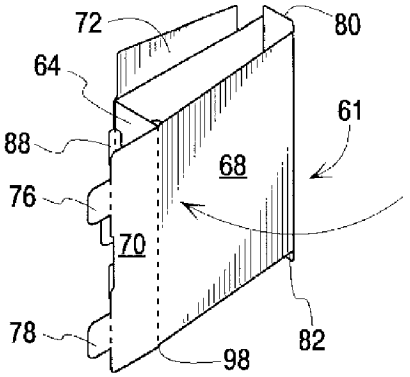
FIG. 15 is a perspective view of the adapter blank with the bottom wall folded into position.
Figure 16:
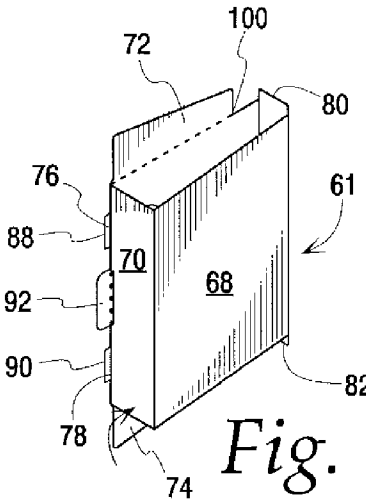
FIG. 16 is a perspective view of the adapter blank with the overlapping wall folded into position and the tabs inserted into the slots formed at the top of the front wall.
Figure 14:
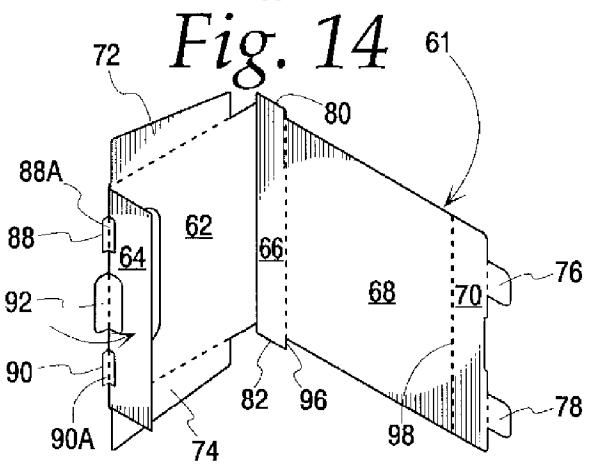
FIG. 14 is a perspective view of the adapter blank with the front and back wall folded into position.

Next, the back wall 66 is folded about flexible hinge or fold line 94 at substantially a 90 degree angle inwardly toward the underside of the top wall 62. After the back wall 66 is positioned, the bottom wall 68 of the adapter is folded about fold line 96 toward the front wall as shown in FIG. 15. Generally, the bottom wall 68 is longer than the top wall 62. When folded, the bottom wall 68 abuts the bottom edge of the front wall 64, and fold line 98 aligns just past the lower edge of the front wall 64. The overlapping wall or panel 70 is hingedly connected to the bottom wall 68 at fold line 98. As shown in FIG. 16, the overlapping wall 70 is folded at fold line 98 over the face of the front wall 64. Tabs 76 and 78 are folded and inserted respectively into slots 88*a* and 90*a* to fasten the overlapping wall 70 flush against the front wall 64. In other embodiments, one of the tabs, such as tab 78, may be longer than the other. Having one of the tabs longer than the other makes it easier to first align and insert the longer tab (78) and then align and insert the second tab (76). In addition to or as a substitute for tabs 76 and 78, the overlapping wall 70 and the front wall 64 may be glued, bonded together, or secured by mechanical or other means known in the art.

Figure 17:
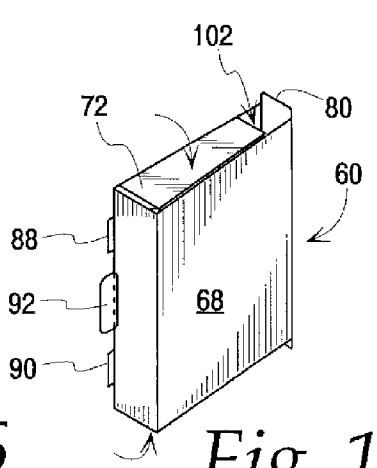
FIG. 17 is a perspective view projection of the adapter blank with the side gussets of the adapter folded into position.

In order to complete construction of the adapter 60, the side gusset panels are folded at fold lines 100 and 101, respectively, toward the bottom wall 68 as shown in FIG. 17. The side gussets 72 and 74 provide further structural support for the adapter 60. In alternate embodiments, glue or other securing means may be applied to different areas of the blank 61, such as where the side gussets abut the front wall 64 and bottom wall 68.

The rear portions of the side gussets 72 and 74 do not abut the back wall 66 but leave an opening through the adapter 60 for a channel or passageway 102. The interior portion of the back wall 66, the underside of the top wall 62 adjacent the back wall 66, the interior portions of the bottom wall 68 adjacent to the back wall 66, and the edges of the gussets 72 and 74 define a channel or passageway 102. The channel or passageway 102 allows a bar, dowel, shaft, or rod (not shown) to be passed through the adapter 60 such that the adapter 60 may be hung from a pulling rack on the bar, dowel, shaft, rod, etc.

Figure 18:
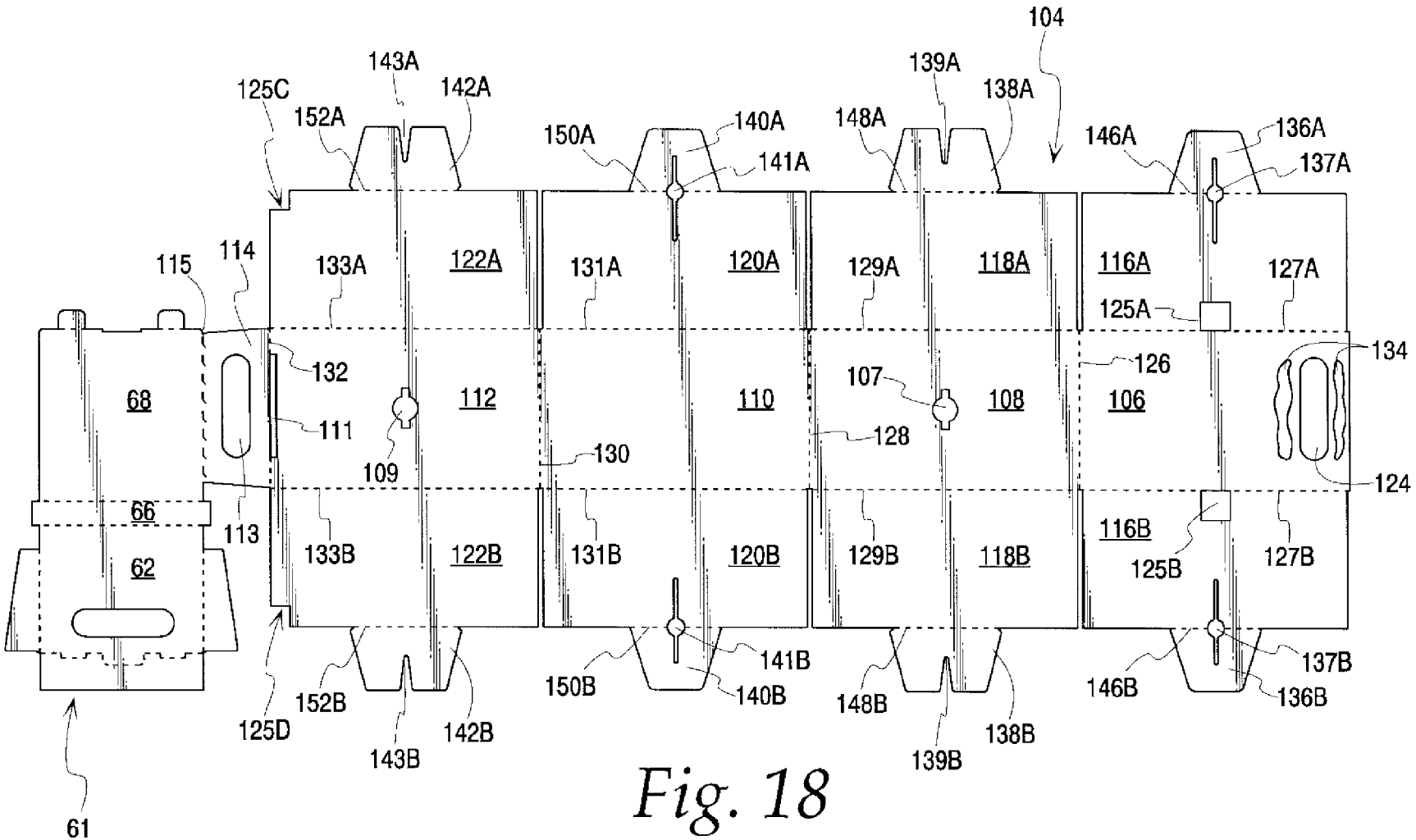
FIG. 18 is a plan view of a carton blank, which also includes a portion defining an adapter blank.
Figure 19:
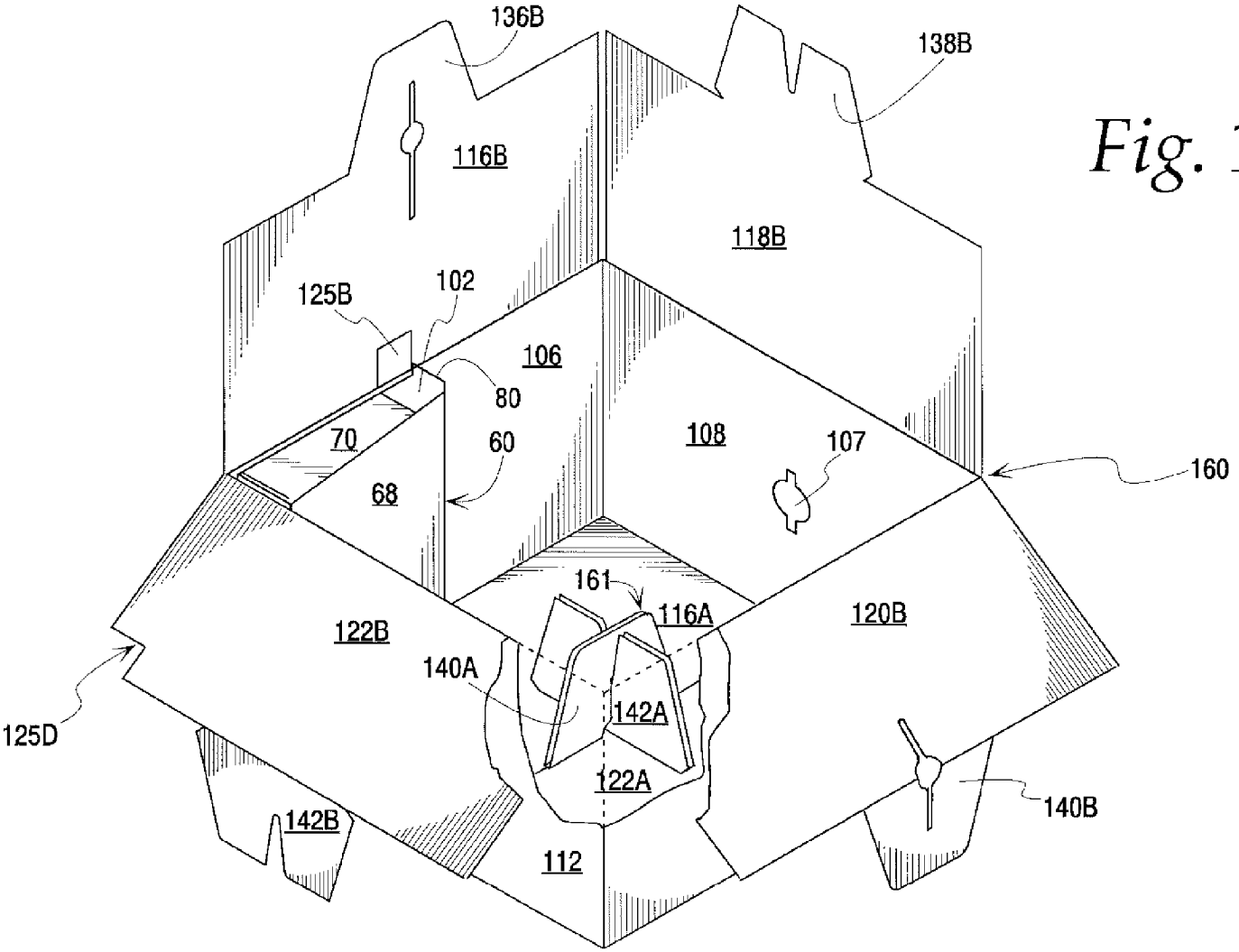
FIG. 19 is a perspective view of a non-reel wire carton formed from the carton blank of FIG. 18, with its flaps open on one side to illustrate the adapter of FIG. 11 installed therein.

FIG. 18 illustrates an embodiment of a blank 104 for forming a non-reel carton to hold the filamentary material, such as those shown in FIGS. 5, 6, and 19. The blank 104 also includes a portion which defines the blank 61 for constructing the adapter 60. The non-reel carton blank 104 and adapter blank 61 made be made from cardboard, paperboard, or other foldable sheet material. In this embodiment, both the carton blank 104 and adapter blank 61 are connected and may be created from the same piece of material. The blank 61 for the adapter is detachable from the portion of the main blank 104 used to construct the non-reel carton.

By manufacturing both the adapter 61 and the carton blank 104 together, the blanks may be stored flat together. This arrangement is advantageous, as it reduces the need to separately manufacture and store adapter blanks. Additionally, different sizes of cartons and their respective adapters can be manufactured and stored together, thus reducing the need to match cartons with their respectively sized adapters when the cartons are later assembled.

In other embodiments, however, the blank 61 for the adapter may be configured such that the adapter may be constructed and inserted into the non-reel carton without having to be detached from the carton blank 104. In these embodiments, additional folding and gluing steps during the manufacture of the carton may be required to assemble the adapter and secure the adapter within the interior of the carton. Additionally, the adapter may be manufactured separately from the carton blank 104 using different materials or scrap material left over from manufacturing other carton blanks.

The non-reel carton blank 104 comprises a plurality of panels or walls for forming an enclosed non-reel carton with opposing spindles. Generally, the panels or walls are substantially rectangular in shape. As shown in FIG. 18, the non-reel carton blank 104 has four center panels: a top panel 106, back panel 108, bottom panel 110, and front panel 112. The center panels (106, 108, 110, and 112) are hingedly connected in an end-to-end relationship. The front panel is also hingedly connected to an overlapping panel 114.

The top panel 106 has an opening or aperture 124 for a handhold. The top panel 106 is hingedly connected by fold line 126 to the back panel 108, and to left and right inner closure panels 116A and 116B by fold lines 127A and 127B, respectively. Left and right inner closure panels 116A and 116B have cutout apertures 125A and 125B located adjacent to the top panel 106. The cutout apertures 125A and 125B align with the cutout notches 125C and 125D located on outer closure panels 122A and 122B when the carton is assembled. The cutouts 125A, 125B, 125C, and 125D, create exterior openings for a rod, shaft or other reinforcing member to be passed through. The exterior openings created by cutouts 125*a*, 125*b*, 125*c*, and 125*d* and the cutouts, themselves, may have other locations, but are generally located outside the circumference of the coil of filamentary material expected to be housed within the carton and/or near the perimeter of the sides of the carton. In this embodiment, the exterior openings are position on the perimeter of the side walls adjacent to the top panel 106.

The exterior openings created by the cutouts 125A, 125B, 125C, and 125D will align with the channel or passageway 102 of the adapter 60 when the non-reel carton is constructed and fitted with the adapter 60. When an adapter is inserted into the non-reel carton, flanges 80 and 82 extend outwardly, through cutouts 125A and 125B in the left and right inner closure panels 116A and 116B, and beyond the surfaces of the left and right outer closure panels 122A and 122B. The engagement of the protruding flanges 80 and 82 with the cutouts 125A and 125B helps to secure and hold the adaptor 60 within the carton. A shaft or rod may then be inserted through the cutouts 125A and 125C, through the channel or passageway 102 of the adapter 60, and out through cutouts 125B and 125D.

The back panel 108 is hingedly connected to left and right outer closure panels 118A and 118B by fold lines 129*a* and 129*b*. In some embodiments, the back panel may optionally incorporate a payout opening 107. A strand of filamentary material is typically paid out from a coil of material stored in the non-reel carton out the front or rear of the carton by way of a payout opening 107. A plastic payout tube 24 as shown in FIGS. 5 and 6 may be mounted in the payout opening.

The bottom panel 110 is hingedly connected to the back panel 108 at fold line 128. The bottom panel 110 is also hingedly connected to front panel 112 at fold line 130 and to left and right inner closure panels 120A, 120B at fold lines 131A and 131B.

The front panel 112 is hingedly connected to left and right outer closure panels 122A and 122B at fold lines 133A and 133B. The front panel 112 also includes a payout opening 109 and slot 111. The slot 111 is designed to receive tab 92 of the adapter 60 and the combination of tab 92 and the slot 111 helps to secure the adapter 60 in the interior corner formed by the top panel 106 and the front panel 112.

The front panel 112 is hingedly connected to overlapping panel 114 at fold line 132. The overlapping panel has opening 113. Opening 113 aligns with opening 124 in the top panel to form a handhold. The non-reel carton blank 104 is removably connected to the adapter blank 61 via tear line 115. In this embodiment, the tear line 115 connects bottom wall 68 of the adapter blank 61 with the overlapping panel 114.

When constructing the non-reel carton using blank 104, the adapter blank 61 is separated from the overlapping panel 114 by tearing it cleanly away via tear line 115. The adapter 60 is assembled using the adapter blank 61 as demonstrated in FIGS. 13-17. The non-reel carton is constructed by folding each panel (106, 108, 110, 112, and 114) at fold lines 126, 128, 130, and 132 inward until it is at a 90 degree angle relative its adjoining panels. Following the proper folding of the panels, overlapping panel 114 will abut the interior surface of the top panel 106 and the opening 113 will align with handhold 124 located in the top panel 106. The overlapping panel 114 is glued to the interior surface of the top panel 106 by one or more strips of glue 134.

The left and right closure panels form the parallel sides of the carton. Additionally, the left and right closure panels have portions for forming spindles within the non-reel carton. Left spindle panels 136A and 140A and left spindle tabs 138A and 142A are hingedly connected to the left side panels respectively at fold lines 146A, 148A, 150A, and 152A. Similarly, right spindle panels 136A and 140B and right spindle tabs 138B and 142B are hingedly connected to the left side panels respectively at fold lines 146B, 148B, 150B, and 152B. While the spindle tabs shown are generally tapered, the blank may be manufactured to have spindle tabs of varying shapes and sizes.

When constructing the non-reel carton from the blank 104, left spindle portions 136A and 140A are folded at 90 degree angles along fold lines 146A and 150A toward the interior of the carton. Left side inner closure panels 116A and 120A are then folded along fold lines 127A and 131A toward the interior of the carton until both panels are flush with each other and the spindle portions 136A and 140A are brought together such that the slots 137A and 141A align. Thereafter, left spindle tabs 138A and 142A are folded at 90 degree angles along fold lines 148A and 152A toward the interior of the carton. The outer closure panels 118A and 122A are then folded along fold lines 129A and 133A until both panels are flush and cover the exterior faces of panels 116A and 120A. Left spindle tabs 138A and 142A are inserted into slots 137A and 141A such that base of the notches 139A and 143A engage the apexes of both slot 137A and slot 141A.

To complete the construction of the non-reel carton, right spindle portions 136B and 140B are folded at 90 degree angles along fold lines 146B and 150B toward the interior of the carton. Right side inner closure panels 116B and 120B are then folded along fold lines 127B and 131B until both panels are flush with each other and the spindle portions 136B and 140B are brought together such that the slots 137B and 141B align. Thereafter, right spindle tabs 138B and 142B are folded at 90 degree angles along fold lines 148B and 152B toward the interior of the carton. The outer closure panels 118B and 122B are then folded along fold lines 129B and 133B until both panels are flush with each other and cover the exterior faces of panels 116B and 120B. Right spindle tabs 138B and 142B are inserted into slots 137B and 141B such that base of the notches 139B and 143B engage the apexes of both slot 137B and slot 141B.

As shown in FIG. 19, after constructing the non-reel carton 160 and the adapter 60 separately, the adapter 60 is inserted into the interior corner formed by the front panel 112 and top panel 106 (the front upper corner of the interior space) of the non-reel carton 160. The top wall of the adapter engages or is in contact with the interior surface of top panel 106 of the carton. The channel or passageway 102 of the adapter aligns with the cutouts 125A and 125B, such that a shaft or rod may be passed through the exterior openings in the carton 160 and through the adapter 60. Flanges 80 and 82 extend through the cutouts 125A and 125B securing the adapter in place. Flanges 80 and 82 also serve as guides for inserting the shaft or road and may act as spacers between adjacent cartons or reels on a pulling rack. The adapter reinforces the carton and reinforces the exterior openings created by the cutouts 125A and 125B.

The handhold opening (not shown) in the top wall of the adapter 60 also aligns with the handhold opening (not shown) in the top of the carton. Thus, the adapter also reinforces the handhold for the carton 160 and minimizes the risk of the carton 160 tearing if the carton 160 is lifted from the handhold (not shown).

As described above, the left side spindle 161 is created within the interior of the non-reel carton by folding and assembling left spindle portions 136A and 140A and left spindle tabs left spindle tabs 138A and 142A. A coil of filamentary material (such as coil 28 of wire or cable as shown in FIG. 5) may be inserted in the carton and around the spindle 161. After inserting the coil of filamentary material, the interior space of the carton 160 is closed by folding right side panels 116B, 118B, 120B, and 122B and assembling the right side spindle as stated above.

The coils or rolls of filamentary materials are generally toroid (doughnut) shaped. When manufactured, coils of filamentary material may have slightly differing diameters and circumferences. The exterior openings in the sides of the carton 160 formed by cutouts 125A, 125B, 125C, and 125D are located such that the exterior openings are outside the circumference of the coil 28. Thus, if an object, such as rod, shaft or other device, is inserted through the exterior openings, the object should not pass through or interfere with coil of filamentary material housed within the carton.

However, when coils of filamentary material are placed in a carton, the coils may further unravel or loosen. Consequently, if a shaft were merely passed through the carton, the shaft may pass through the coil of filamentary material and cause the material to snag when the material is pulled out of the non-reel carton. The enclosed passageway 102 of the adapter 60 separates the shaft, rod, etc from coil of filamentary material and prevents the rod from passing through the coil.

Figure 20:
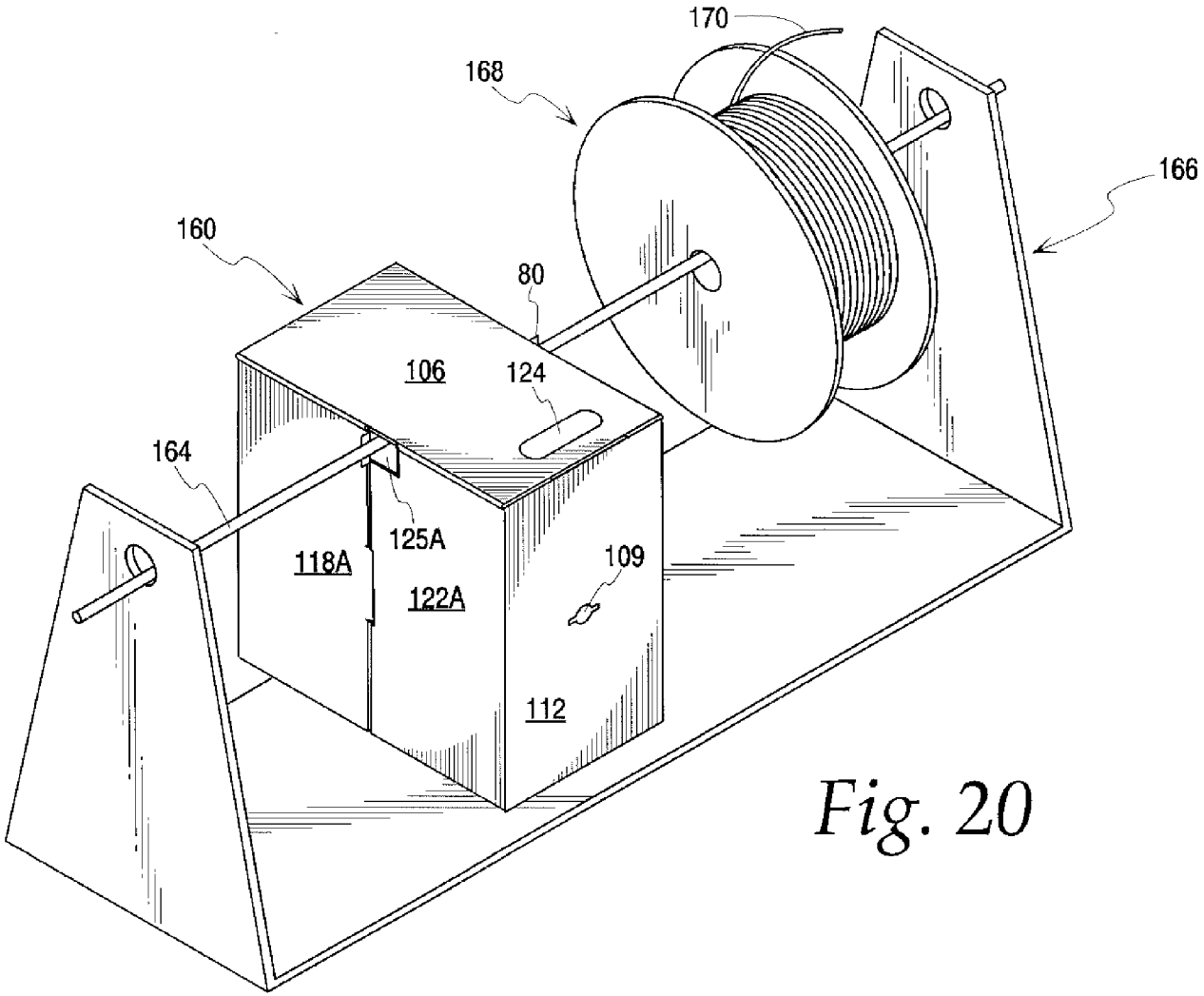
FIG. 20 is a perspective view of a non-reel wire carton that is hung from a shaft next to a reel of filamentary material, illustrating how the adapter is utilized to hang a closed carton containing a non-reel coil of filamentary material.

FIG. 20 illustrates how the combination of the non-reel carton 160 and adapter 60 (not shown) is hung from a shaft 164 of a pulling rack 166. The structure and placement of adapter 60 in the corner of the carton 160 reinforces or provides structural support for the carton and the exterior openings, such that when the carton is hung utilizing the adapter, gravity and pulling loads on the carton 160 are spread out over a larger surface area. Thus, the likelihood that the top panel 106 might tear when the carton 160 is hung from a shaft 164 is eliminated.

FIG. 20 also illustrates the advantages the combination of an adapter 60 and non-reel carton 160 have over a standard reel 168 of filamentary material 170. The carton 160 may be carried by the handhold opening 124, which is reinforced by the location of the adapter 60. The non-reel carton 160 may then be easily mounted on a pull rack 166 by passing a shaft 164 through the exterior opening formed by cutout 125A, the channel or passageway 102 in the adapter 60 and out of the opposing exterior opening formed by cutout 125B on the other side of the carton. Flanges 80 and 82 act as guides for the mounting the shaft and help to secure the adapter 60 in the front upper corner of the carton 160. Flanges 80 and 82 may also, but not necessarily, reinforce the exterior openings formed by cutouts 125A, 125B, 125C, and 125D.

Wire or other filamentary material may be passed from the interior of the carton 160, through the payout opening 109 in the front panel 112 of the carton. When the carton 160 is hung on the pulling rack 166, the carton 160 will not move or creep forward when the filamentary material is pulled out by an electrician. Unlike the standard reel 168, which will continue to rotate and release the wire 170 when wire is pulled from the reel 168, the wire or filamentary material stays within the carton 160.

While this invention has been described with reference to certain illustrative aspects, it will be understood that this description shall not be construed in a limiting sense. Rather, various changes and modifications can be made to the illustrative embodiments without departing from the true spirit, central characteristics and scope of the invention, including those combinations of features that are individually disclosed or claimed herein. For example, the size, shape and number of the panels, walls, and apertures may be adjusted to accommodate different sizes of filamentary material or articles other than filamentary wire. Additionally, the adapter blank may be connected in a different manner or in different locations. The adapter may be connected to or used in association with entirely different carton blank configurations from those described above. Another alternate form might split the adapter into two separate pieces, each reinforcing a single side of the carton. That is, there could be a first adaptor piece connected to one side of the carton and reinforcing the aperture therein. This first adaptor piece could be a simple corner or angle piece engaging the top panel 106 and inner closure panel of the carton. The vertical leg of the corner piece would have an opening aligned with the aperture in the carton. A second similar adaptor piece, wholly separate from the first adaptor piece, could be connected to the other side of the carton where it would reinforce the aperture in the other side of the carton. The shaft would extend through each separate adaptor piece. Furthermore, it will be appreciated that any such changes and modifications will be recognized by those skilled in the art as an equivalent to one or more elements of the following claims, and shall be covered by such claims to the fullest extent permitted by law.

We claim:

1. A non-reel carton for dispensing filamentary material, comprising:

a carton, having a plurality of panels which define an interior of the carton, the panels at least partially enclosing the interior of the carton on six sides;

a pair of cutouts defined in opposing panels of the carton, said opposing panels being among those which enclose the interior of the carton on six sides, the cutouts being located near an edge of the carton and aligned with one another along an axis that is perpendicular to said opposing panels; and an adapter connected to the carton in the interior thereof, the adapter having a portion defining a passageway, whereby the combination of the carton and adapter may receive a shaft inserted from the exterior of the carton and through the passageway.

2. The non-reel carton of claim 1 wherein the adapter further comprises a pair of flanges.

3. The non-reel carton of claim 2 wherein the passageway is parallel to the flanges.

4. The non-reel carton of claim 3 wherein the flanges extend from the interior of the carton to the exterior of the carton.

5. The non-reel carton of claim 1 wherein the adapter further comprises a pair of knobs which extend from the interior of the carton to the exterior of the carton.

6. The non-reel carton of claim 1 wherein the adapter is constructed from cardboard.

7. The non-reel carton of claim 1 wherein the adapter is located in a corner of the carton.

8. A carton blank for dispensing filamentary material, comprising:

four center panels, the center panels hingedly connected to one another in an end-to-end relationship;

at least a first closure panel hingedly connected to one of the center panels on one side thereof and at least one second closure panel hingedly connected to one of the center panels on the other side thereof such that the closure panels at least partially close the sides of the carton not closed by the center panels; and an adapter blank removably connected at a tear line to at least one of the center or closure panels and wherein the adapter blank has at least one fold line defining at least two hingedly connected walls.

9. The carton blank of claim 8 wherein each of the closure panels is connected to a spindle portion.

10. The carton blank of claim 8 wherein the closure panels are hingedly connected opposite one another to the same center panel and each have a cutout located substantially near the perimeter of the closure panel.

11. An article for dispensing filamentary material comprising:

a carton having a plurality of panels, the panels being substantially rectangular and defining an interior of the carton, the panels at least partially enclosing the interior of the carton on six sides;

a pair of aligned cutouts formed in opposing panels on opposite sides of the carton, said opposing panels being among those which enclose the interior of the carton on six sides, the cutouts being located substantially on the perimeter of the panels in which they are formed and the cutouts being aligned along an axis that is perpendicular to the panels in which they are formed.

12. The article of claim 11 for dispensing filamentary material further comprising an adapter, and the adapter having a passageway aligned with the cutouts such that the combination of the carton and the adapter may hang from a shaft.

13. The article of claim 11 for dispensing filamentary material wherein the cutouts are reinforced by additional material.

14. The article of claim 13 for dispensing filamentary material wherein the additional material comprises an adapter such that the combination of the carton and adapter may hang from a shaft.

15. A method of preparing a carton having a plurality of panels for mounting on a shaft, comprising the steps of:

forming aligned cutouts in panels on opposite sides of the carton and substantially in the perimeter of the carton, the cutouts being aligned along an axis that is perpendicular to the panels in which they are formed such that a shaft can be inserted into and through the cutouts;

reinforcing the carton adjacent the cutouts by connecting to the carton an adaptor, the adapter being located such that it is spaced from contents placed in the carton; and aligning the adaptor with the cutouts such that a shaft can be inserted into and through the cutouts.

16. The method of claim 15 further comprising the step of forming a passageway in the adaptor and wherein the aligning step is further characterized by the step of aligning the passageway with the cutouts such that the shaft can be inserted into and through the passageway and cutouts.

17. A non-reel carton for dispensing a coil of filamentary material, comprising:

top, bottom, front, rear and side panels joined together to define an interior of the carton;

cutouts in the side panels at least partially aligned with one another along an axis that is perpendicular to the side panels for receiving a shaft therethrough; and an adapter disposed in the interior of the carton and having a reinforcing plate in engagement with the top panel, the adapter further including at least one wall that divides the interior of the carton into a passageway and a coil compartment, the passageway being aligned with the cutouts to receive a shaft inserted from the exterior of the carton, at least a portion of the reinforcing plate being engageable with said inserted shaft to spread the load of the shaft onto the top panel, the coil compartment being sized to receive a non-reel coil of filamentary material therein, with said at least one wall being located to prevent entry of the coil of filamentary material into the passageway, the adapter being located such it is that spaced from filamentary material placed in the carton.

* * * * *